United States Patent [19]

Müller

[11] Patent Number: 4,909,422

[45] Date of Patent: Mar. 20, 1990

[54] PROCESS FOR PREVENTING THE FORMATION OF DEPOSITS IN A DISCHARGE NOZZLE DURING TEEMING OF MOLTEN METAL

[75] Inventor: Bruno Müller, Muhen, Switzerland

[73] Assignee: Stoping Aktiengesellschaft, Baar, Switzerland

[21] Appl. No.: 831,917

[22] Filed: Feb. 21, 1986

[30] Foreign Application Priority Data

Feb. 23, 1985 [DE] Fed. Rep. of Germany ..... 3506426

[51] Int. Cl.[4] ..... B22D 11/00; B22D 37/00

[52] U.S. Cl. ..... 222/590; 164/66.1; 164/475; 164/488; 222/603

[58] Field of Search ..... 164/66.1, 259, 415, 164/475, 437, 488; 222/590, 603

[56] References Cited

U.S. PATENT DOCUMENTS 3,253,307 5/1966 Griffiths et al. ..... 222/590
3,502,134 3/1970 Orehoski ..... 164/475
4,003,561 1/1977 Cudby ..... 222/603
4,203,538 5/1980 Luhrsen ..... 222/603

FOREIGN PATENT DOCUMENTS 1379236 1/1975 United Kingdom ..... 222/590

*Primary Examiner*—Richard K. Seidel
*Attorney, Agent, or Firm*—Wenderoth, Lind & Ponack

[57] ABSTRACT

Molten metal is teemed through a discharge nozzle controlled by a shut-off device during which inert gas is injected into an inlet portion of the discharge nozzle. A reduction of the cross section of the discharge nozzle due to the formation therein of deposits is prevented by injecting at least a portion of the inert gas into the inlet portion in a pulse-like manner by controlling the supply of the inert gas with respect to time and volume. The inert gas may be supplied from a source as partial volumes through plural branch lines each provided with shut-off and control valves, and the operation of such valves may be programmed to control the duration and repetition period of the supply of each partial volume.

35 Claims, 1 Drawing Sheet

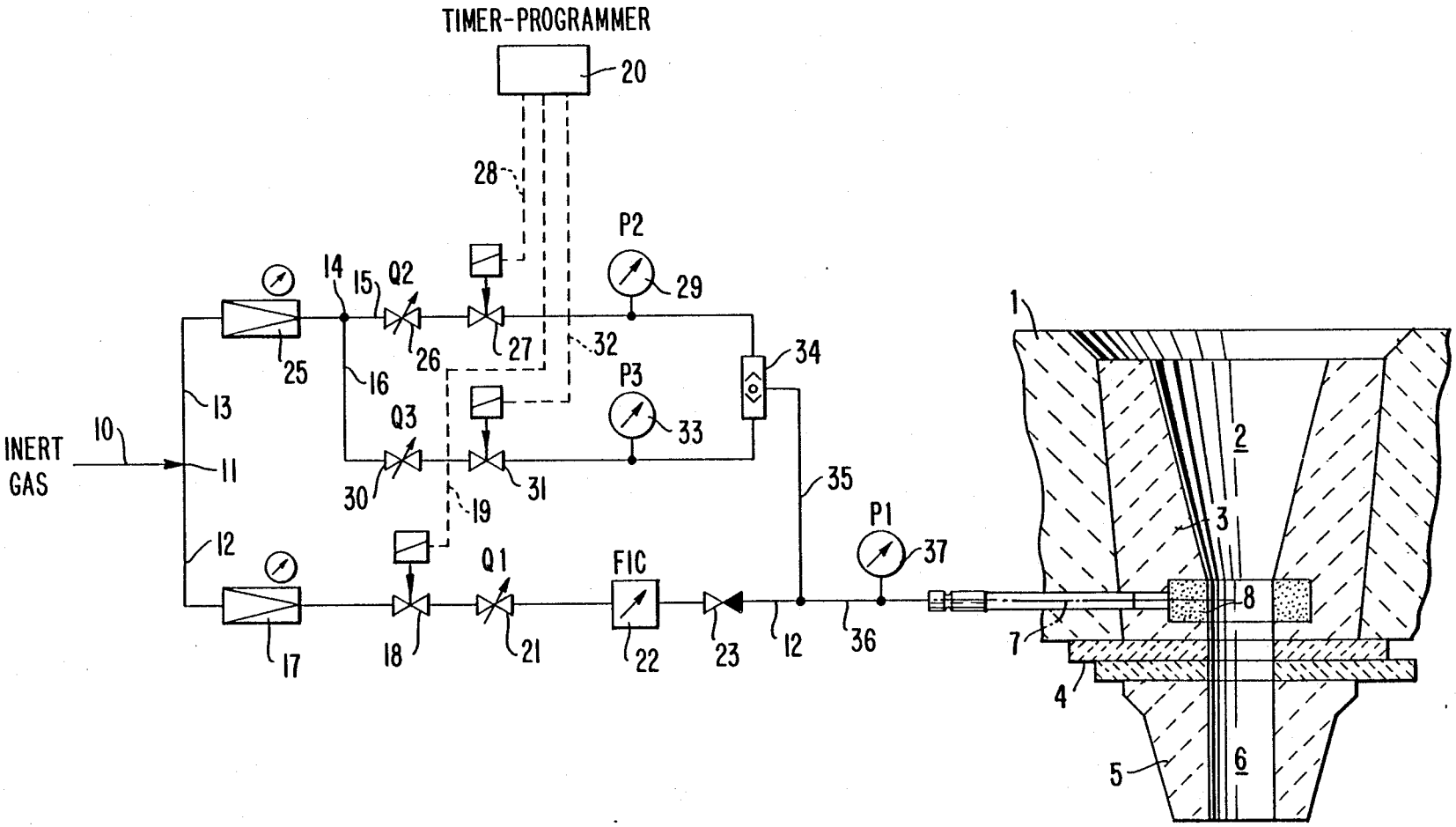
TIMER-PROGRAMMER
INERT GAS
P1
P2
P3
FIC
Q1
Q2
Q3

PROCESS FOR PREVENTING THE FORMATION OF DEPOSITS IN A DISCHARGE NOZZLE DURING TEEMING OF MOLTEN METAL

BACKGROUND OF THE INVENTION

The present invention relates to a process for the teeming of molten metal through a discharge nozzle controlled by a shut-off device during which inert gas is injected into an inlet portion of the discharge nozzle, whereby it is possible to prevent a reduction of the cross section of the discharge nozzle due to the formation therein of deposits.

During the teeming of various molten metals, for example steel, it is known to introduce into at least one location in the discharge nozzle of the vessel or runner from which the molten metal is discharge an inert gas, for example argon, to reduce or to prevent the oxidation of the metal, for example steel, during the teeming operation. During the teeming of aluminum or silicon killed steel there occurs the highly undesirable phenomenon of the gradual formation of deposits in the discharge nozzle with the resultant reduction of the cross section thereof. This makes it impossible to maintain a constant pouring or teeming rate. Thus, there is formed on the wall of the discharge nozzle a deposit of, for example, alumina. A gradual deposition of this type takes place even in the presence of the inert gas in the discharge nozzle.

SUMMARY OF THE INVENTION

It now surprisingly has been discovered that this phenomenon does not occur, or at least takes place in a significantly delayed manner and to a significantly lesser extent, if at least part of the inert gas is introduced into the inlet portion of the discharge nozzle in a pulse-like manner.

Accordingly, it is an object of the present invention to improve the process of teeming of molten metal through a discharge nozzle controlled by a shut-off device while preventing a reduction of the cross section of the discharge nozzle due to the formation therein of deposits by injecting at least a portion of the inert gas into the inlet portion in a pulse-like manner by controlling the supply of the gas with respect to time and volume.

By this operation it is possible to prevent the gradual clogging of the discharge nozzle or to rapidly eliminate deposits that do form.

The process of the present invention may be carried out appropriately in a variety of different ways by the time and volume control of the supply of the inert gas. Thus, a partial volume of the inert gas may be supplied in a pulse-like manner. Alternatively, the entire volume of the inert gas may be supplied in a pulsed manner. The inert gas may be supplied in a constant volume portion which is periodically interrupted i.e. stopped, and during the periods of interruption of the constant volume portion of the gas there may be supplied a pulsed portion of the gas. These alternative methods may be effected conveniently by dividing the inert gas supply into plural gas flows and injecting partial volumes of the gas at differential pulse durations and differential pulse repetition periods. For example, one partial gas volume may be supplied at a pulse duration of 0.75 seconds, repeated periodically every 25 seconds, i.e. at a pulse repetition period of 25 seconds, and another partial gas volume may be supplied at a pulse duration of 0.5 seconds, periodically repeated every 125 seconds, and these two partial gas volumes may be added to or superimposed on a constant flow supply of gas.

In order to carry out a selected one of the various possible alternative manners of gas supply, to achieve the most favorable results under the prevailing conditions, inert gas from a supply source may be divided into partial gas volumes supplied through plural branch pipelines, each of which is provided with shut-off and control valves for selectively controlling the pulse duration and pulse repetition period of the partial gas volume through each respective line, the selected operable branch lines for a given selected operation then being joined to a common supply into the inlet portion of the discharge nozzle.

BRIEF DESCRIPTION OF THE DRAWING

Other objects, features and advantages of the present invention will be apparent from the following detailed description, taken with the accompanying drawing, wherein:

The single figure is a schematic representation of a system for carrying out the process of the present invention.

DETAILED DESCRIPTION OF THE INVENTION

In the drawing is shown a portion of a metallurgical vessel at the area of a teeming or pouring outlet therefrom. The vessel contains the molten metal to be discharged and includes a refractory lining 1 having therethrough a nozzle brick 3 defining a funnel-shaped pouring orifice 2. A shut-off device 4, shown schematically as an upper stationary refractory plate and a lower movable refractory plate, controls the discharge of molten metal through orifice 2 and through a pouring or discharge opening 6 of a discharge nozzle 5 mounted beneath device 4. There is provided an arrangement for injecting an inert gas, for example argon, into an inlet portion of the discharge nozzle. This structure is illustrated as line 7 leading into a porous sleeve 8 located in the inlet of the nozzle. These structures are intended to be conventional and may be in other known forms than illustrated.

During operation of the shut-off device for controlling the discharge or teeming of molten metal, there occurs the phenomenon of the formation in the discharge nozzle of deposits. This reduces the cross section of the discharge nozzle, and this is disadvantageous since it becomes impossible to maintain a constant pouring or discharge rate.

This disadvantageous phenomenon of conventional systems and processes however is overcome in accordance with the present invention by providing that at least a portion of the inert gas is injected into the inlet portion of the discharge nozzle in a pulse-like manner. This is achieved by controlling the supply of the inert gas with respect t time and volume.

One arrangement for achieving this process is illustrated schematically in the drawing. Thus, inert gas from a source 10 is divided at a junction 11 into partial volumes passing through branch lines 12 and 13. Branch line 12 supplies a constant volume or flow portion of the inert gas. Branch line 13 is divided at a further junction 14 into branch lines 15 and 16 for the pulse-like supply of partial volumes of the inert gas at differentially adjustable pulse durations and differentially adjustable pulse repetition periods.

Branch line 12 has therein a pressure reducing valve 17 and a shut-off device 18 arranged successively in the direction of flow. Shut-off device 18 may, for example, be in the form of a magnetic valve and may be connected by means of an electrical conductor 19 to a timer-programmer control device 20 which may be of any conventional type capable of controlling, for example by an adjustable program, the times and periods of operation of valve 18, as well as other valves to be discussed below. A flow control valve 21, subsequently arranged in branch line 12 and adjustable manually, serves to set or establish a volume Q1 of the constant flow of gas. A subsequent flow governor 22 maintains a constant volume under a pressure that is not always constant due to variable counter pressure in the discharge nozzle. A check valve 23 also is arranged in branch line 12.

In branch line 13 is a pressure reducing valve 25, which is adjustable, for example to 6 bar, valve 25 being located upstream of junction 14. Branch line 15 has therein a manually adjustable flow control valve 26 to regulate or establish a volume Q2 and downstream thereof a shut-off device 27 in the form of a magnetic valve connecting by means o an electrical conductor 28 to timer-programmer 20 for time control. A manometer 29 serves to display the pressure P2 in branch line 15.

In branch line 16, in a similar manner, is a manually adjustable flow control valve 30 for control of a volume Q3, a downstream shut-off device in the form of a magnetic valve 31 connected by means of an electrical conductor 32 with timer-programmer 20, and a manometer 33 for displaying the pressure P3 in branch line 16.

The branch lines 15, 16 open into a dual check valve 34 connected by means of a line 35 with branch line 12 at a position downstream of check valve 23 therein. Thus, by way of a subsequent common line 36 having therein a manometer 37 to display counter pressure Pl, both the constant flow of gas introduced through branch line 12 and/or partial volumes of the gas introduced through branch lines 15 and/or 16 are conducted together through the porous sleeve 8 into the discharge nozzle, and this supply will be in a pulse-like manner.

The volumes of the inert gas flows through each of the branch lines is controlled by valves 21, 26, 30, and this may be achieved manually. The timer-programmer device 20 is programmed for a desired adjustment of valves 18, 27, 31 to regulate the pressure levels and the durations and repetition periods of the pulses. For example, device 20 could be programmed to operate valve 27 to achieve a partial volume Q2 through branch line 15 at a pulse duration of 0.75 seconds to be repeated every 25 seconds, and to operate valve 31 to achieve a partial volume Q3 through branch line 16 at a pulse duration of 0.5 seconds, repeated every 125 seconds. These partial flows, at differentiated pulse durations and pulse repetition periods, then would be added to or superimposed on the constant volume Q1 supplied through branch line 12.

Alternatively, the device 20 may be programmed to provide that only one branch line is open for the pulse-like supply of inert gas while the other two branch lines are interrupted, or else only branch line 12 for the supply of a constant flow of gas may be interrupted, and one or more of branch lines 15, 16 may be opened so that the inert gas is supplied exclusively in a pulsating fashion with differential pulse durations and differential pulse repetition periods. If the inert gas is supplied simultaneously through all of branch lines 12, 15, 16, then the partial, pulsed volumes are superposed on the constant volume to produce a pulsating supply of a constant flow of inert gas.

It will be apparent from the above that a large number of possible variations of the manner of pulse-like supply of inert gas are possible.

The shut-off device 4 schematically illustrated in the drawing is intended to be a conventional sliding closure unit. This specific arrangement however could be replaced by other conventional arrangements. For example, conical nozzle or sleeve 5 could be replaced by a third refractory plate to which a refractory sleeve is connected.

Although the present invention has been described and illustrated with preferred features thereof, it will be understood that various modifications and changes to the specifically described and illustrated arrangements may be made without departing from the scope of the present invention.

I claim:

1. In a process for the teeming of molten metal through a discharge nozzle controlled by a shut-off device during which inert gas is injected into an inlet portion of the discharge nozzle, the improvement comprising preventing a reduction of the cross section of the discharge nozzle due to the formation therein of deposits by:

injecting at least a portion of said inert gas into said inlet portion in a rhythmical or regularly reoccurring pulse-like manner by controlling the supply of said gas with respect to time and volume.

2. The improvement claimed in claim 1, wherein said injecting comprises supplying a constant flow first portion of said gas, and adding to said first portion an additional rhythmical or regularly reoccurring pulsed flow portion of said gas.

3. The improvement claimed in claim 2, comprising adding to said first portion plural additional pulsed flow portions of said gas having different pulse durations and different pulse repetition periods.

4. The improvement claimed in claim 2, comprising controlling the pulse repetition period of said additional pulsed flow portion of said gas.

5. The improvement claimed in claim 1, wherein said injecting comprises supplying the entire volume of said inert gas in a rhythmical or regularly reoccurring pulse-like manner.

6. The improvement claimed in claim 5, comprising supplying said gas volume in the form of plural partial volumes having different pulse durations and different pulse repetition periods.

7. The improvement claimed in claim 5, comprising controlling the pulse duration and pulse repetition period of said entire volume of said gas.

8. The improvement claimed in claim 1, wherein said injecting comprises supplying a constant volume portion of gas, periodically stopping the supply of said constant volume portion of gas, and during the periods of stopping of the supply of said constant volume portion of gas supplying a rhythmical or regularly reoccurring pulsed portion of said gas.

9. The improvement claimed in claim 8, comprising supplying said pulsed portion in the form of plural partial volumes having different pulse durations and different pulse repetition periods.

10. The improvement claimed in claim 8, comprising controlling the pulse duration and pulse repetition period of said pulsed portion of gas.

11. The improvement claimed in claim 8, comprising controlling the duration and repetition period of stopping of the supply of said constant volume portion of gas.

12. The improvement claimed in claim 1, wherein said injecting comprises supplying said gas from a source as partial gas volumes through plural branch lines each provided with shut-off and control valves, and operating said valves to control the duration and repetition period of supply of each said partial volume.

13. In a process for the teeming of molten metal through a discharge nozzle controlled by a shut-off device during which inert gas is injected into an inlet portion of the discharge nozzle, the improvement comprising preventing a reduction of the cross section of the discharge nozzle due to the formation therein of deposits by:

injecting at least a portion of said insert gas into said inlet portion in a pulse-like manner by controlling the supply of said gas with respect to time and volume, said injecting comprising supplying plural pulsed flow portions of said gas of adjustable pulse durations and different pulse repetition periods.

14. The improvement claimed in claim 13, wherein said injecting comprises supplying a constant flow first portion of said gas, and adding to said first portion additional pulsed flow portions of said gas.

15. The improvement claimed in claim 14, comprising controlling the pulse repetition period of said additional pulsed flow portions of said gas.

16. The improvement claimed in claim 13, wherein said injecting comprises supplying the entire volume of said inert gas in a pulse-like manner.

17. The improvement claimed in claim 16, comprising supplying said gas volume in the form of plural partial volumes having different pulse durations and different pulse repetition periods.

18. The improvement claimed in claim 16, comprising controlling the pulse duration and pulse repetition period of said entire volume of said gas.

19. The improvement claimed in claim 13, wherein said injecting comprises supplying a constant volume portion of gas, periodically stopping the supply of said constant volume portion of gas, and during the periods of stopping of the supply of said constant volume portion of gas supplying pulsed portions of said gas.

20. The improvement claimed in claim 19, comprising supplying said pulsed portions in the form of plural partial volumes having different pulse durations and different pulse repetition periods.

21. The improvement claimed in claim 19, comprising controlling the pulse duration and pulse repetition period of said pulsed portions of gas.

22. The improvement claimed in claim 19, comprising controlling the duration and repetition period of stopping of the supply of said constant volume portion of gas.

23. The improvement claimed in claim 13, wherein said injecting comprises supplying said gas from a source as partial gas volumes through plural branch lines each provided with shut-off and control valves, and operating said valves to control the duration and repetition period of supply of each said partial volume.

24. In a process for the teeming of molten metal through a discharge nozzle controlled by a shut-off device during which inert gas is injected into an inlet portion of the discharge nozzle, the improvement comprising preventing a reduction of the cross section of the discharge nozzle due to the formation therein of deposits by:

injecting at least a portion of said inert gas into said inlet portion in a pulse-like manner by controlling the supply of said gas with respect to time and volume, such that said portion of said gas is supplied in pulses of equal duration and at equal pulse repetition periods.

25. The improvement claimed in claim 24, wherein said injecting comprises supplying a constant flow first portion of said gas, and adding to said first portion an additional pulsed flow portion of said gas.

26. The improvement claimed in claim 25, comprising adding to said first portion plural additional pulsed flow portions of said gas having different pulse durations and different pulse repetition periods.

27. The improvement claimed in claim 25, comprising controlling the pulse repetition period of said additional pulsed flow portion of said gas.

28. The improvement claimed in claim 24, wherein said injecting comprises supplying the entire volume of said inert gas in a pulse-like manner.

29. The improvement claimed in claim 28, comprising supplying said gas volume in the form of plural partial volumes having different pulse durations and different pulse repetition periods.

30. The improvement claimed in claim 28, comprising controlling the pulse duration and pulse repetition period of said entire volume of said gas.

31. The improvement claimed in claim 24, wherein said injecting comprises supplying a constant volume portion of gas, periodically stopping the supply of said constant volume portion of gas, and during the periods of stopping of the supply of said constant volume portion of gas supplying pulsed portions of said gas.

32. The improvement claimed in claim 31, comprising supplying said pulsed portion in the form of plural partial volumes having different pulse durations and different pulse repetition periods.

33. The improvement claimed in claim 31, comprising controlling the pulse duration and pulse repetition period of said pulsed portion of gas.

34. The improvement claimed in claim 31, comprising controlling the duration and repetition period of stopping of the supply of said constant volume portion of gas.

35. The improvement claimed in claim 24, wherein said injecting comprises supplying said gas from a source as partial gas volumes through plural branch lines each provided with shut-off and control valves, and operating said valves to control the duration and repetition period of supply of each said partial volume.

* * * * *